US006308949B1

(12) United States Patent
Ito et al.

(10) Patent No.: US 6,308,949 B1
(45) Date of Patent: Oct. 30, 2001

(54) MATERIAL-FEEDING DEVICE HAVING DIRECTION-CORRECTING FUNCTION

(75) Inventors: Wataru Ito, Tanashi; Humio Maeno, Tokorozawa; Tetsuya Yamamoto; Hiroshi Ikeda, both of Tanashi, all of (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/380,744

(22) PCT Filed: Aug. 28, 1998

(86) PCT No.: PCT/JP98/03858

§ 371 Date: Sep. 13, 1999

§ 102(e) Date: Sep. 13, 1999

(87) PCT Pub. No.: WO99/61358

PCT Pub. Date: Dec. 2, 1999

(30) Foreign Application Priority Data

May 28, 1998 (JP) ..... PCT/JP98/02366

(51) Int. Cl.[7] ..... B65H 11/00

(52) U.S. Cl. ..... 271/251; 271/248; 271/236; 271/274; 271/138

(58) Field of Search ..... 271/225, 226, 271/227, 235, 236, 246, 248, 251, 252, 138, 264, 274; 400/579, 630, 631, 632, 636

(56) References Cited

U.S. PATENT DOCUMENTS

| | | | | |
|---|---|---|---|---|
| 4,203,588 | * | 5/1980 | Joosten | 271/246 |
| 4,248,151 | | 2/1981 | Real . | |
| 4,266,762 | * | 5/1981 | Kramer et al. | 271/225 |
| 4,438,918 | * | 3/1984 | Ito et al. | 271/251 |
| 4,877,234 | * | 10/1989 | Mandel | 271/225 |
| 5,088,848 | * | 2/1992 | De Falco et al. | 400/630 |
| 5,172,900 | * | 12/1992 | Uno et al. | 271/125 |
| 5,209,133 | * | 5/1993 | Ballard | 271/273 X |
| 5,253,862 | * | 10/1993 | Acquaviva et al. | 271/251 |
| 5,340,098 | * | 8/1994 | Gunderson | 271/9.09 X |
| 5,463,256 | * | 10/1995 | Wang et al. | 271/274 |
| 5,577,719 | * | 11/1996 | Nicoli | 271/227 |
| 5,601,283 | * | 2/1997 | Pinckney | 271/228 |
| 5,873,664 | * | 2/1999 | Umemo | 271/236 X |
| 6,059,284 | * | 5/2000 | Wolf et al. | 271/227 |
| 6,149,150 | * | 11/2000 | Onipchenko et al. | 271/240 |

FOREIGN PATENT DOCUMENTS

| | | |
|---|---|---|
| 56-60429 | 5/1981 | (JP) . |
| 56-127532 | 10/1981 | (JP) . |
| 63-9549 | 1/1988 | (JP) . |
| 4-22657 | 1/1992 | (JP) . |
| 9-327951 | 12/1997 | (JP) . |

* cited by examiner

*Primary Examiner*—Christopher P. Ellis
*Assistant Examiner*—Patrick Mackey
(74) *Attorney, Agent, or Firm*—Finnegan, Henderson, Farabow, Garrett & Dunner, L.L.P.

(57) ABSTRACT

A material-feeding device (14) includes a base (52), a material passage (54) formed on the base, at least one guide member (56, 58) provided in the material passage and having a material-guide surface **(56*a*, 58*a*), a direction-correcting roller assembly (60) provided in the material passage, and a conveyor roll mechanism (62) disposed downstream of the direction-correcting roller assembly in relation to a material-feeding direction, for conveying a material along the material passage. The direction-correcting roller assembly (60) includes a pair of integrally rotatable polygonal rollers (76) having a common rotation axis oblique to the material-guide surface and a freely rotatable ball (78) opposed to the pair of polygonal rollers and elastically supported in an operative position closer to the polygonal rollers to define a gap between the ball and each of the polygonal rollers for allowing the material to be inserted into the gap when the ball is in the operative position. The direction-correcting roller assembly (60) holds the material between the pair of polygonal rollers (76) and the ball (78), and intermittently feeds the material toward the guide members (56, 58)**.

22 Claims, 13 Drawing Sheets

MATERIAL-FEEDING DEVICE HAVING DIRECTION-CORRECTING FUNCTION

TECHNICAL FIELD

The present invention relates to a material-feeding device for feeding a sheet-like material, such as printing paper, in a predetermined direction. Particularly, the present invention relates to a material-feeding device having a direction-correcting function for correcting a feeding direction of a material.

BACKGROUND ART

Material-feeding devices for feeding a sheet-like material in a predetermined direction have been used in printers which are employed as output devices for on-line terminal units or word processors. It is known that the material-feeding device used in the printer has a direction-correcting function for correcting the feeding direction of an inserted material to be printed, to enable a printing operation to be performed at a correct position on the material.

In printers for industrial use, such as those used for printing on a bankbook or a slip in a bank (hereinafter referred to as a bankbook printer), the printing operation may be carried out sequentially or continuously on various materials to be printed having different thicknesses. Particularly, when a notebook type material such as a bankbook is fed, the material may produce, depending on an opened page to be printed, material parts having different thicknesses, corresponding to the left and right halves relative to a stitching line of the material, so that the oblique movement of the material is liable to occur during the continuous feeding of such material parts having different thickness. Accordingly, to accommodate such a situation, it is required for the material-feeding device to possess a direction-correcting function for correctly and stably feeding various materials to be printed, having different thicknesses, to a printing area.

As a conventional material-feeding device having a direction-correcting function, the U.S. Pat. No. 4,248,151 (Real) discloses a tape guide apparatus which can be used as a printing paper guide in an impact printer. This tape guide apparatus is adapted to feed a tape in a predetermined direction while maintaining an edge of the running tape in contact with a guide reference surface, and includes a pair of rollers arranged obliquely to the reference surface but parallel to each other. The running tape is clamped or held in a nip formed between these rollers.

Also, as a conventional material-clamping device in a material-feeding device of a printer, Japanese Unexamined Patent Publication (Kokai) No. 4-22657 (JP4-22657) discloses a material-clamping device having a function for uniformly locating a front end of a material such as a bankbook or a slip. This material-clamping device is provided with a clamp section including a polygonal roller and a ball biased toward the polygonal roller and an end locating section including a retractable shutter arranged back of the clamp section in relation to the feeding direction of the material. The material is fed by the rotation of the polygonal roller and is abutted against the shutter. When being abutted on the shutter, the material is clamped or held between the ball and a circumferential corner of the polygonal roller. When the polygonal roller further rotates, the polygonal roller becomes out of contact at a circumferential flat surface portion thereof with the ball, and thereby, in this condition, the material can be conveyed toward a printing area of the printer by another conveyor roll.

It is possible that both of the above conventional material-feeding devices cannot correctly and stably feed various materials having different thicknesses. Particularly, if they are used for a thinner material, the pair of rollers or the polygonal roller/ball, acting to hold the material therebetween, may bend the material when the material is abutted against the guide reference surface or the end locating shutter to make the correct transportation of the material difficult, and also may cause creases or folds in the material.

Also, since the polygonal roller disclosed in JP4-22657 is arranged to rotate stepwise by a desired angle by means of a rotary solenoid, it is possible that the polygonal roller cannot correct the feeding direction of the material while continuously feeding the material, unlike the pair of rollers of the material-feeding device described in Real.

Accordingly, it is required to develop a material-feeding device having a direction-correcting function for correctly and stably feeding a material in a predetermined direction even though a thickness of the material might vary. Such a material-feeding device is also required in ink-jet printers which have recently become popular in various fields because of low printing noise and small body size.

As described above, in printers for industrial use, such as a bankbook printer, there is a case where, when a notebook type material is printed, the material parts having different thicknesses may be produced on the left and right sides about a stitching line of the material to be printed, depending on an opened page of the material. In this case, since it is necessary, in, e.g., a dot impact printer conventionally used generally as a bankbook printer, to maintain a distance between a printing head and a surface of the material to be printed, a level of the printing head is sequentially changed, when the material parts with difference thicknesses are subsequently printed, in response to the difference in the thickness. As a result, the conventional bankbook printer tends have a complicated driving structure for the printing head, and to require a relatively longer time from the introduction of the bankbook to its discharge after the printing.

DISCLOSURE OF THE INVENTION

An object of the present invention is to provide a material-feeding device having a direction-correcting function which enables various materials having different thicknesses to be correctly and stably fed in a predetermined direction.

Another object of the present invention is to provide a material-feeding device having a high-performance direction-correcting function which can be applied to a feeding device for materials to be printed incorporated in printers for industrial use and, particularly, in bankbook printers.

A further object of the present invention is to provide an ink-jet printer provided with such a material-feeding device as described above.

A still further object of the present invention is to provide a material-feeding device which can be used in a printer carrying out a printing operation on a notebook-like material to be printed and which can continuously print material parts having different thicknesses without changing a height of a printing head and thus can shorten a time required for the printing operation.

To achieve the above objects, the present invention provides a material-feeding device comprising a base; a material passage formed on the base; at least one guide member provided in the material passage and having a material-guide surface; a direction-correcting roller assembly provided in the material passage, the direction-correcting roller assembly including a pair of integrally rotatable polygonal rollers having a common rotation axis oblique to the material-guide surface of the guide member and a freely rotatable ball opposed to the pair of polygonal rollers and elastically supported in an operative position closer to the polygonal rollers to define a gap between the ball and each of the polygonal rollers for allowing a material to be inserted into the gap when the ball is in the operative position; a driving mechanism for driving the pair of polygonal rollers for rotation; and a conveyor roll mechanism provided downstream, in a material-feeding direction, of the direction-correcting roller assembly, for conveying the material along the material passage.

In a preferred aspect, the direction-correcting roller assembly is arranged to define a minimum gap between the pair of polygonal rollers and the ball when the ball is in the operative position and when the pair of polygonal rollers are in a rotational angular position wherein a circumferential corner of each of the polygonal rollers is opposed to the ball.

It is preferred that the material passage is formed between a first supporting plate statically disposed above the base and a second supporting plate elastically supported on the base to be opposed to the first supporting plate.

In this arrangement, it is advantageous that the first supporting plate and the second supporting plate include an upper support face and a lower support face, respectively, which are opposed to each other to slidably hold the material therebetween, the lower support face acting to elastically urge the material against the upper support face.

It is also advantageous that the guide member comprises a first guide member statically projecting in the material passage and positioning the material-guide surface in parallel to the material-feeding direction, and a second guide member retractably projecting in the material passage and located downstream, in the material-feeding direction, of the direction-correcting roller assembly.

The material-feeding device may further comprise detecting means for detecting a position of the material in the material passage.

The material-feeding device may further comprise an actuating mechanism for shifting the ball elastically supported in the operative position in a direction away from the pair of polygonal rollers.

It is preferred that the driving mechanism rotates the pair of polygonal rollers in cooperation with the conveyor roll mechanism.

The conveyor roll mechanism may include at least one conveyor roll assembly, the at least one conveyor roll assembly including a driving roll rotatable about a stationary axis and a plurality of driven rolls biased toward the driving roll and rotatable about a movable axis.

The material-feeding device may further comprise an actuating mechanism for simultaneously shifting the driven rolls in a direction away from the driving roll.

It is also advantageous that the driving roll is arranged at an upper side of the material passage, and that the driven rolls are arranged at a lower side of the material passage and are individually elastically biased in a direction toward the driving roll.

The present invention also provides an ink-jet printer comprising a machine frame; a printing head provided reciprocatingly movably in a predetermined direction in the machine frame, the printing head including a plurality of nozzles for ejecting ink-droplets and at least one nozzle surface on which the nozzles open; ink-supply means for supplying ink to the printing head; and a material-feeding device for feeding a material to be printed into a printing area opposed to the printing head in the machine frame; wherein the material-feeding device comprises a base placed in the machine frame; a material passage formed on the base; at least one guide member provided in the material passage and having a material-guide surface; a direction-correcting roller assembly provided in the material passage, the direction-correcting roller assembly including a pair of polygonal rollers having a common rotation axis oblique to the material-guide surface of the guide member and a freely rotatable ball opposed to the pair of polygonal rollers and elastically supported in an operative position closer to the polygonal rollers to define a gap between the ball and each of the polygonal rollers to allow the material to be printed to be inserted into the gap when the ball is in the operative position; a driving mechanism for driving the pair of polygonal rollers for rotation; and a conveyor roll mechanism provided downstream, in a material-feeding direction, of the direction-correcting roller assembly, for conveying the material to be printed into the printing area along the material passage.

In the preferred aspect, the direction-correcting roller assembly of the material-feeding device is arranged to define a minimum gap between the pair of polygonal rollers and the ball when the ball is in the operative position and when the pair of polygonal rollers are in a rotational angular position wherein a circumferential corner of each of the polygonal rollers is opposed to the ball.

It is preferred that the guide member of the material-feeding device comprises a first guide member statically projecting in the material passage and positioning the material-guide surface in parallel to the material-feeding direction, and a second guide member retractably projecting in the material passage and located downstream, in the material-feeding direction, of the direction-correcting roller assembly.

It is advantageous that the conveyor roll mechanism of the material-feeding device includes a pair of conveyor roll assemblies arranged at both sides of the printing area in relation to the material-feeding direction, each of the conveyor roll assemblies including a driving roll rotatable about a stationary axis and a plurality of driven rolls biased toward the driving roll and rotatable about a movable axis, and wherein the second guide member is provided to retractably project between upstream one of the conveyor roll assemblies in relation to the material-feeding direction and the printing area.

The present invention further provides an ink-jet printer as defined above, adapted to be used as a bankbook printer, wherein the driving roll is arranged at an upper side of the material passage, and wherein the driven rolls are arranged at a lower side of the material passage and are individually elastically biased in a direction toward the driving roll.

The present invention further provides an ink-jet printer as defined above, adapted to be used as a bankbook printer, wherein the material passage of the material-feeding device is formed between a first supporting plate statically disposed above the base and a second supporting plate elastically supported on the base to be opposed to the first supporting plate.

In this arrangement, it is advantageous that the first supporting plate and the second supporting plate include an upper support face and a lower support face, respectively, which are opposed to each other to slidably hold the material therebetween, the lower support face acting to elastically urge the material against the upper support face.

The present invention also provides a material-feeding device comprising a base; a first supporting plate statically arranged above the base; a second supporting plate elastically supported on the base to be opposed to the first supporting plate, to form a material passage between the first and second supporting plates; and a conveyor roll mechanism provided in the material passage for conveying the material along the material passage; wherein the first supporting plate and the second supporting plate include an upper support face and a lower support face, respectively, which are opposed to each other to slidably hold the material therebetween, the lower support face acting to elastically urge the material against the upper support face; and wherein the conveyor roll mechanism includes a driving roll arranged at an upper side of the material passage to be rotatable about a stationary axis and a plurality of driven rolls arranged at a lower side of the material passage to be rotatable about a movable axis, the driven rolls being individually elastically biased in a direction toward the driving roll.

The present invention also provides an ink-jet printer comprising a material-feeding device as defined above.

BRIEF DESCRIPTION OF THE DRAWINGS

The above and other objects, characteristics and advantages of the present invention will be explained in more detail with reference to the embodiments illustrated in the attached drawings, wherein.

BEST MODE FOR CARRYING OUT THE INVENTION

Figure 1:
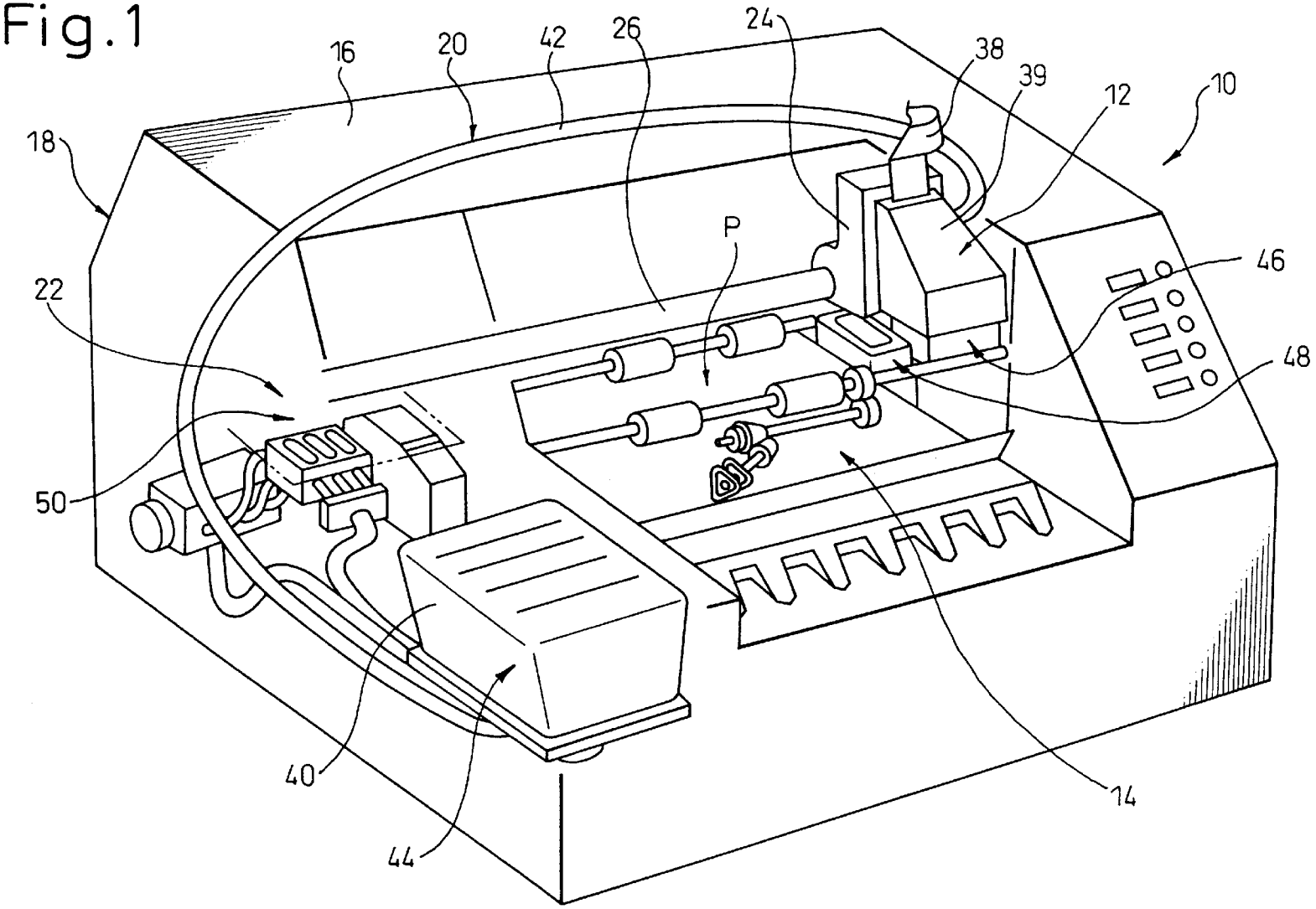
FIG. 1 is a schematic perspective view showing an ink-jet printer provided with a material-feeding device, according to one embodiment of the present invention, wherein several main components of the ink-jet printer are visibly illustrated in a perspective manner.
Figure 2:
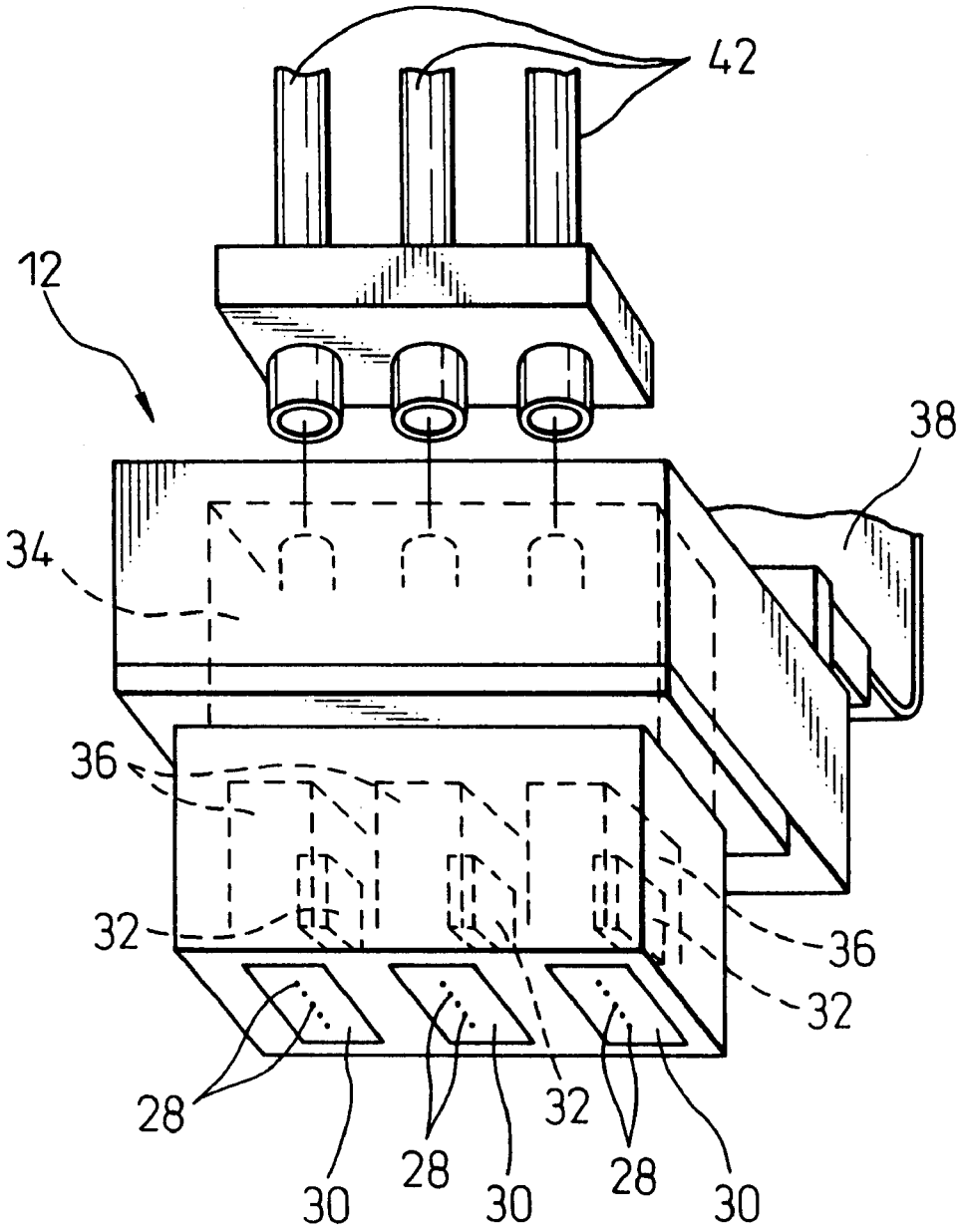
FIG. 2 is a schematic perspective view of a printing head of the ink-jet printer shown in FIG. 1.
Figure 3:
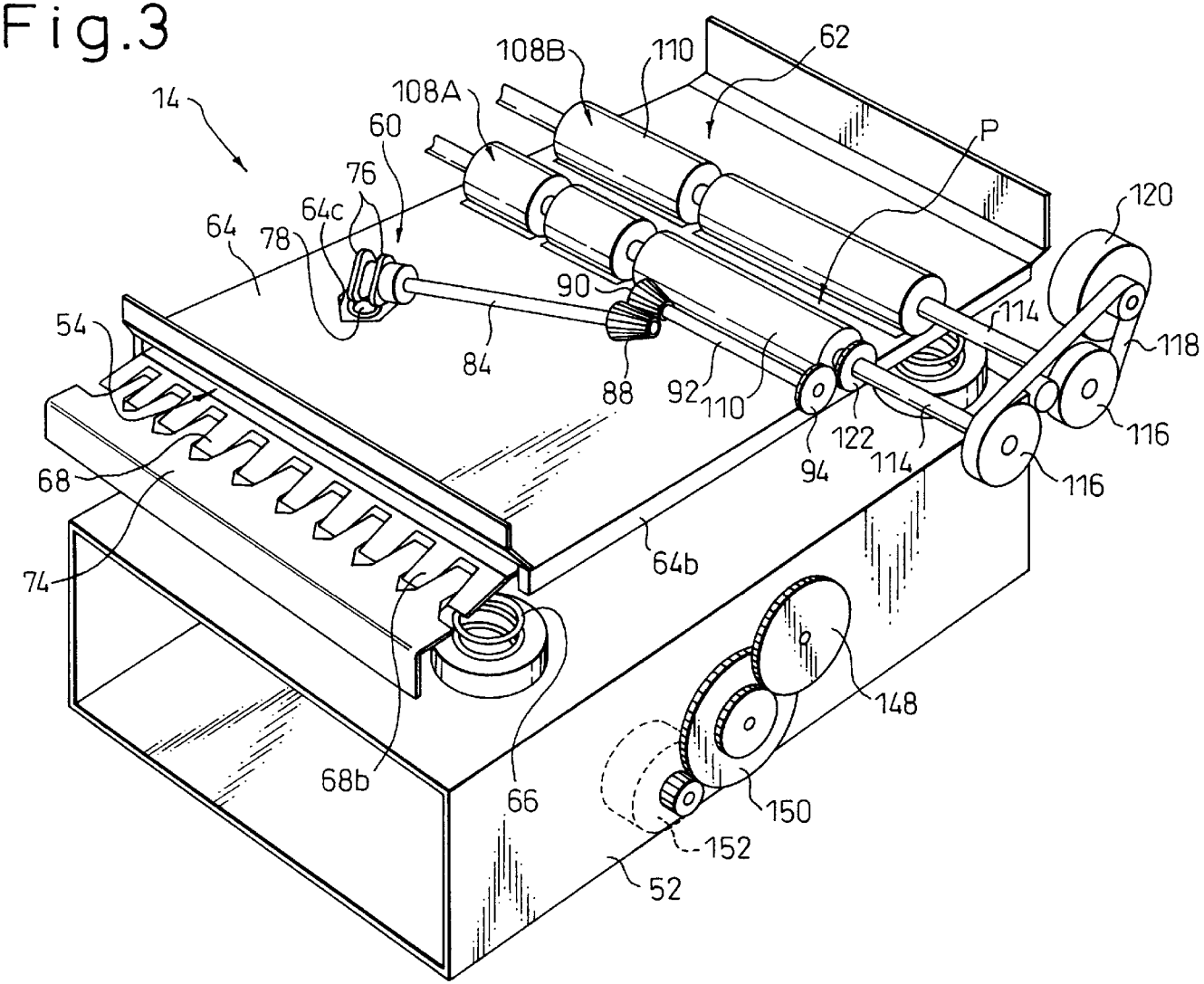
FIG. 3 is a schematic perspective view showing the appearance and arrangement of a material-feeding device according to one embodiment of the present invention.
Figure 4:
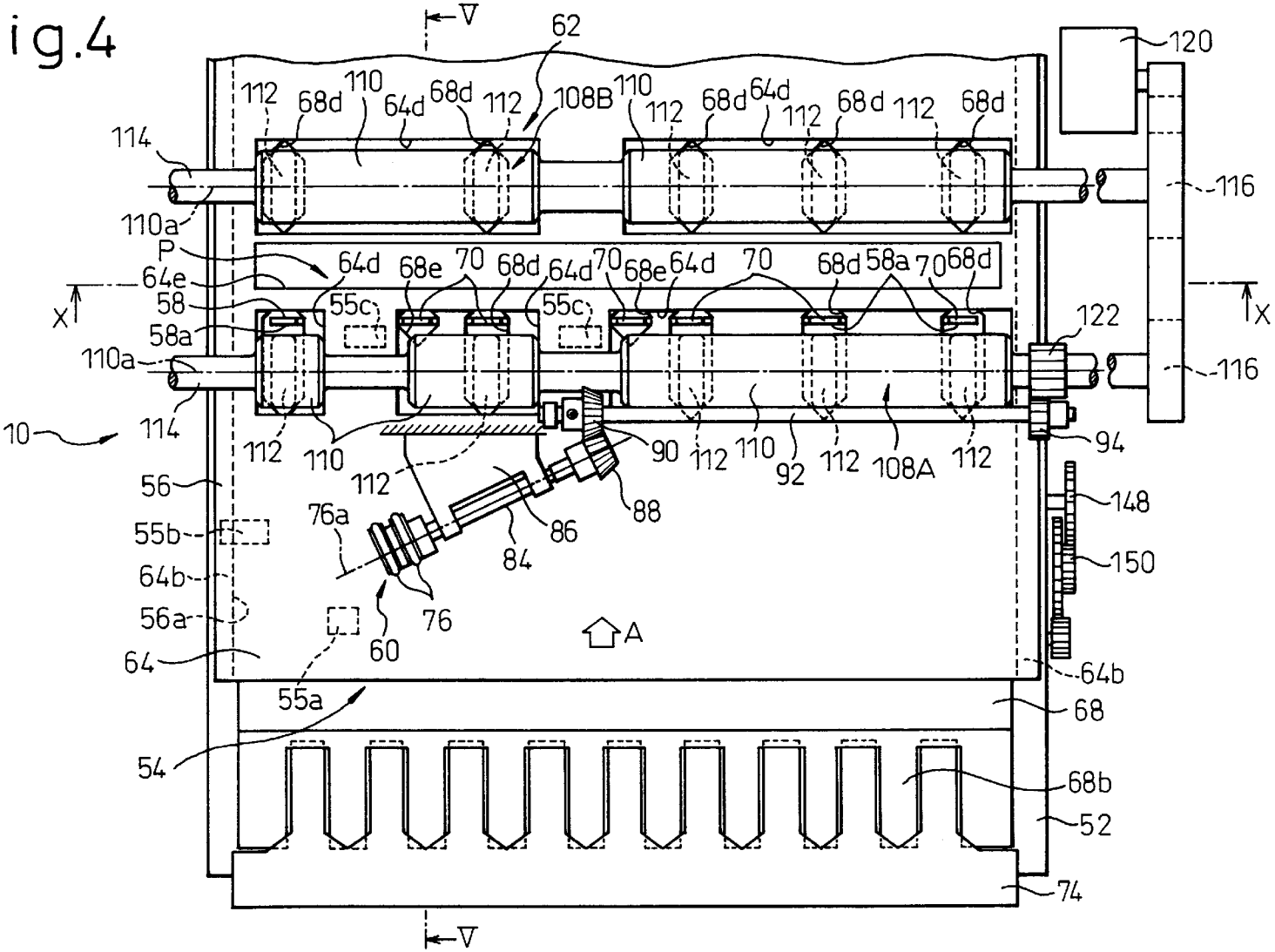
FIG. 4 is a schematic plan view of the material-feeding device shown in FIG. 3.
Figure 5A:
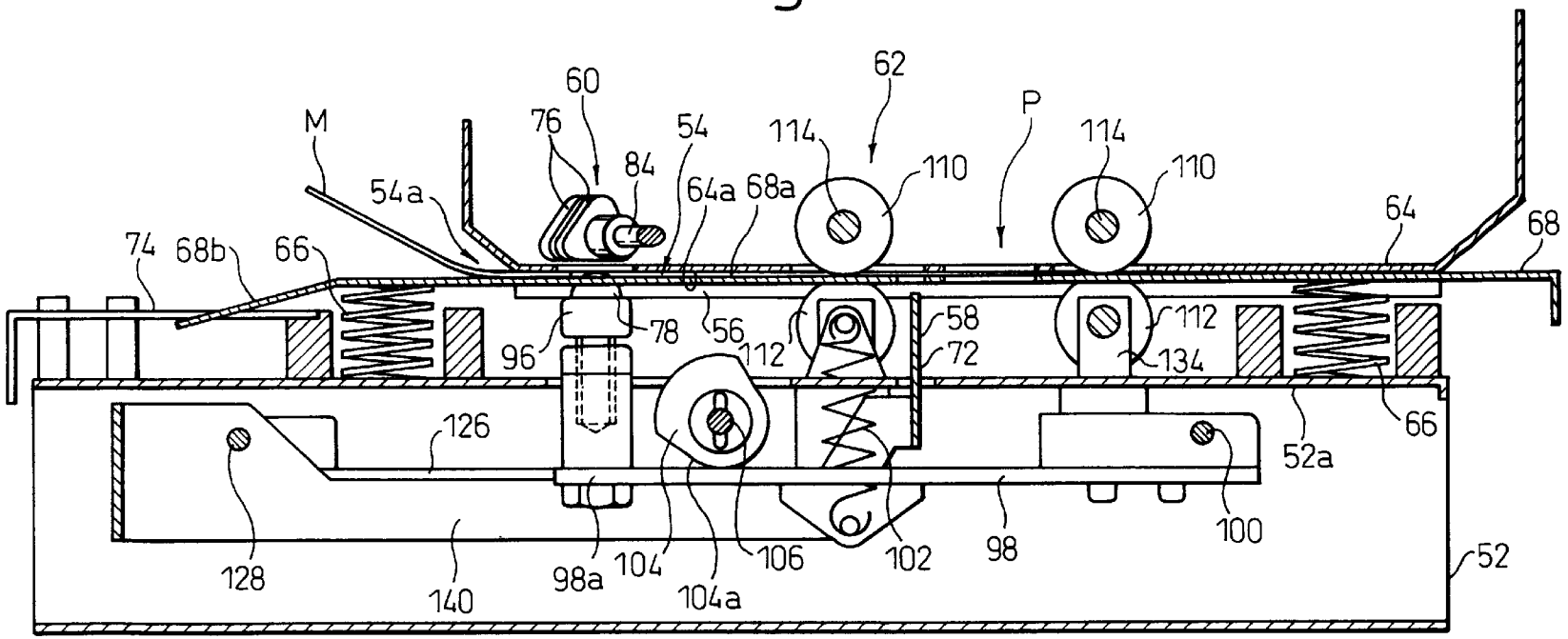
FIG. 5A is a schematic sectional view taken along line V—V in FIG. 4.

Referring now to the drawings, FIG. 1 is a schematic perspective view of an ink-jet printer 10 according to one embodiment of the present invention, wherein several main components thereof are visibly illustrated in a perspective manner, and FIG. 2 is a schematic perspective view of a printing head assembly 12 (hereinafter referred to as a "printing head 12") of the ink-jet printer 10. FIG. 3 is a schematic perspective view showing the appearance and arrangement of a material-feeding device 14 according to one aspect of the present invention, FIG. 4 is a schematic plan view of the material-feeding device 14, and FIG. 5A is a schematic sectional view of the material-feeding device 14. It should be noted that the material-feeding device according to the present invention is applicable not only to an ink-jet printer but also to other printers as well as various apparatuses for handling sheet-like materials.

Referring to FIG. 1, the ink-jet printer 10 is provided with a machine frame 18 including an openable/closable housing 16 and a machine body (not shown), a printing head 12 provided reciprocatingly movably in a predetermined direction (usually in a horizontal direction relative to a reference plane on which the printer is installed) in the machine frame 18, ink-supply means 20 for supplying ink to the printing head 12, a material-feeding device 14 for feeding a material to be printed M (see FIG. 5A) into a printing area P opposed to the printing head 12 in the machine frame 18, and maintenance means 22 including a plurality of functional stations arranged to be distributed in opposite end regions of the reciprocation range of the printing head 12 in the machine frame 18.

The printing head 12 is fixed to a carriage 24 which in turn is carried on a guide bar 26 extending in the horizontal direction in the machine frame 18 so as to be movable in the axial direction of the bar. During the printing operation, the printing head 12 is reciprocated in the horizontal direction along the guide bar 26 by means of a driving mechanism not shown.

As schematically shown in FIG. 2, the printing head 12 is provided with a plurality of nozzles 28 for ejecting ink-droplets, a nozzle surface 30 on which the nozzles 28 open, and an actuator 32 composed of piezoelectric elements for making the nozzles 28 eject ink-droplets. In the illustrated embodiment, the printing head 12 includes separate three subheads 36, each of which is provided with the plural nozzles 28, the nozzle surface 30 and the actuator 32. Between the three subheads 36 of the printing head 12 and the ink-supply means 20, a pressure-fluctuation damping unit or damper 34 is provided for suppressing the pressure fluctuation of ink in an ink-supply path and thus stabilizing a meniscus of ink entering the respective nozzles 28. A flexible circuit board 38 for applying a driving voltage onto the actuators 32 is shown in FIGS. 1 and 2. Also, as shown in FIG. 1, the printing head 12 is usually hidden by an openable/closable cover 39 attached to the carriage 24.

The ink-supply means 20 is provided with an ink-storage section 40 arranged at a position apart from the printing head 12 in the machine frame 18, and an ink-supply conduit 42 connecting the printing head 12 with the ink-storage section 40, to supply a quick-dry type pigment ink to the printing head 12 during the printing operation. In the illustrated embodiment, the ink-supply conduit 42 is formed of a sufficiently flexible tube so as not to interfere with the reciprocating motion of the printing head 12.

Also in the illustrated embodiment, the ink-supply means 20 includes separate three ink-storage sections 40 and separate three ink-supply conduits 42 connecting the respective ink-storage sections 40 to the respective subheads 36 of the printing head 12 (FIG. 2). Accordingly, the ink-jet printer 10 is usable as a color printer. Further, in the illustrated embodiment, the three ink-storage sections 40 are formed in a cartridge type ink tank 44 detachably mounted at a predetermined position on the machine frame 18.

The plural functional stations constituting the maintenance means 22 include a sealing station 46 for substantially sealing and covering the plural nozzles 28 opening on the nozzle surface 30 of the printing head 12 when the printer does not operate, so as to prevent the ink in the nozzles 28 from drying, a discharging station 48 for making the nozzles 28 of the printing head 12 discharge the ink with increased viscosity in the nozzles 28 when the printer does not operate, and a cleaning station 50 for sucking and removing the ink with increased viscosity in the nozzles 28 when the printer does not operate, washing the nozzle surface 30 and wiping the nozzle surface 30. In the illustrated embodiment, the sealing station 46 and the discharging station 48 are disposed in one end region (a right end region in the drawing) of the reciprocation range of the printing head, and the cleaning station 50 is disposed in another end region (a left end region in the drawing) of the reciprocation range of the printing head.

Such a distributive arrangement of the various functional stations facilitates the effective utilization of an idle space in the machine frame 18 of the ink-jet printer 10. That is, in the general ink-jet printer, since the printing operation is carried out on the material to be printed while the printing head reciprocates in the predetermined direction, the reciprocation range of the printing head is determined to be wider than a dimension of the material-feeding device disposed opposite to the printing head. As a result, an idle space is inevitably formed around the material-feeding device. Therefore, in the ink-jet printer 10, the above-mentioned functional stations for establishing a multifunctional maintenance system are distributively arranged in the idle space, so as to effectively prevent a machine size from being enlarged. Further, the ink-jet printer 10 having such a multifunctional maintenance system can safely use the quick-drying pigment ink, and thus can be suitably applied to printers for industrial use, e.g., to a bankbook printer.

As shown in FIGS. 3 to 5A, the material-feeding device 14 according to one aspect of the present invention arranged beneath the reciprocation range of the printing head 12 includes a hollow box-shaped base 52 statically placed in the machine frame 18, a material passage 54 formed on the base 52, guide members 56, 58 provided in the material passage 54 and having material-guide surfaces 56*a*, 58*a*, a direction-correcting roller assembly 60 provided in the material passage 54 for correcting the feeding direction of the material to be printed M by intermittently feeding the material M inserted into the material passage 54 toward the guide members 56, 58, and a conveyor roll mechanism 62 disposed downstream of the direction-correcting roller assembly 60 as seen in the material-feeding direction, for holding the material M and conveying the latter into the printing area P of the ink-jet printer 10 and for releasing the material M from the printing area P.

In this regard, the material to be printed M can be used in this embodiment on the assumption that it has such a shape that at least front and left edges of the surface to be printed are generally orthogonal to each other as seen in a direction where the material M is inserted into the material passage 54.

The material passage 54 is formed between a first supporting plate 64 statically disposed above the base 52 and a second supporting plate 68 elastically supported on the base 52 via a plurality of bearing springs 66 at a position beneath the first supporting plate 64. The first supporting plate 64 is fixedly connected to, e.g., the machine frame 18. The first supporting plate 64 and the second supporting plate 68 are generally rectangular-shaped planar rigid plates having flat support faces 64*a* and 68*a* opposed to each other, and slidably hold the material to be printed M in the material passage 54 formed therebetween under the elastic urging force of the bearing springs 66.

The second supporting plate 68 can be shifted in a floating manner beneath the first supporting plate 64 by the elastic support of the bearing springs 66, so that an angle of the support face 68*a* relative to the support face 64*a* can be varied. As a result, the first and second supporting plates 64, 68 can slidably hold therebetween various materials to be printed M having different thicknesses, such as a bankbook or a slip, while properly varying a space of the material passage 54. Also, it is possible to hold therebetween a notebook-like material to be printed M, such as a bankbook, which is in an opened state at a desired page and thereby produces material parts having different thickness on left and right sides about a stitching line of the material M, under a generally entirely uniform pressure. In this state, the upper surface of the material to be printed M, i.e., the surface to be printed, is kept at a constant level in the machine frame 18 by the support face 64*a* of the first supporting plate 64, whereby a distance between the nozzle surface 30 of the printing head 12 and the surface to be printed of the material M is always maintained at a constant value irrespective of the variation of a thickness of the material to be printed M.

The guide members 56, 58 includes a first guide member 56 statically projecting in the material passage 54 and positioning the material-guide surface 56*a* in parallel to the material-feeding direction (FIG. 4, an arrow A), and a second guide member 58 located downstream, in the material-feeding direction, of the direction-correcting roller assembly 60 to project in the material passage 54 in a retractable manner. The first guide member 56 is constituted by one of a pair of walls 64*b* extending from the opposite edges of the first supporting plate 64 toward the second supporting plate 68. The second supporting plate 68 is always located between the pair of walls 64*b* when shifting in a floating manner above the base 52. The second guide member 58 is constituted by a plurality of shutters 70 arranged close to the conveyor roll mechanism 62, each of which includes a material-guide surface 58*a* generally orthogonal to the material-guide surface 56*a* of the first guide member 56. These shutters 70 are integrally connected to each other under the second supporting plate 68 to form a comb-teeth plate 72 (see FIG. 8) as described later.

The second supporting plate 68 has an extension 68*b* of a comb-teeth shape at a plate end near a material inlet 54*a* of the material passage 54. The extension 68*b* is combined in a non-contact manner with a shelf member 74 of a similar comb-teeth shape fixed to the base 52, so as to constitute a platform on which the material to be printed M is placed.

A plurality of sensors 55*a* to 55*c* are provided in the material passage 54 for detecting a position of the material to be printed M put in the material passage 54. An inlet sensor 55*a* located in the vicinity of the material inlet 54*a* of the material passage 54 detects that the material M is inserted into the material passage 54. A first guide sensor 55*b* located in the vicinity of the material-guide surface 56*a* of the first guide member 56 and upstream of the conveyor roll mechanism 62 as seen in the material-feeding direction detects that the material M passing through the direction-correcting roller assembly 60 comes into contact with the material-guide surface 56*a*. A plurality of second guide sensors 55*c* located in the vicinity of the plural material-guide surfaces 58*a* of the second guide member 58 and downstream of the first guide sensor 55*b* as seen in the material-feeding direction detect that the material M passing through the direction-correcting roller assembly 60 comes into contact with the material-guide surfaces 58*a*. These sensors 55*a* to 55*c* may be formed from a well-known proximity sensor, photoelectric sensor or the like.

The direction-correcting roller assembly 60 is constituted by a pair of integrally rotatable polygonal rollers 76 having a common rotation axis 76*a* oblique to the material-guide surfaces 56*a*, 58*a* of the first and second guide members 56, 58, and a freely rotatable ball 78 located opposite to and in the vicinity of the pair of polygonal rollers 76. The pair of polygonal rollers 76 are arranged near the upper side of the first supporting plate 64, and the ball 78 is arranged near the lower side of the second supporting plate 68. Openings 64*c* and 68*c* are formed in the first supporting plate 64 and the second supporting plate 68 at positions corresponding to the pair of polygonal rollers 76 and the ball 78, respectively (see FIG. 6A), to allow the pair of polygonal rollers 76 and the ball 78 to approach each other through the openings 64*c*, 68*c*.

Figure 6A:
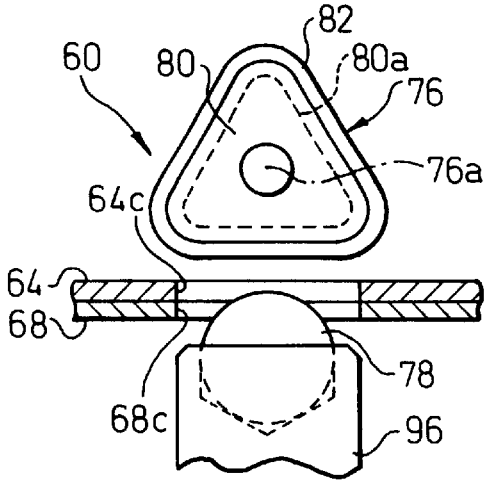
FIG. 6A is an enlarged front view of a direction-correcting roller assembly in the material-feeding device shown in FIG. 3.
Figure 6B:
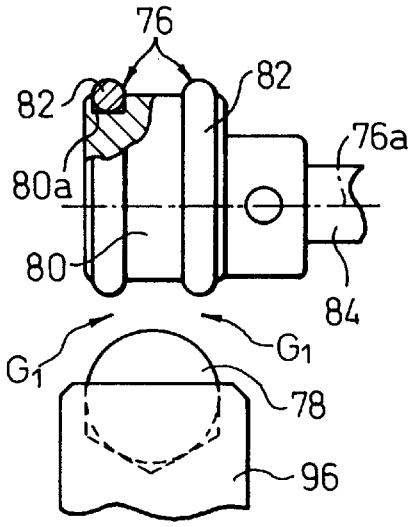
FIG. 6B is a partially cut-out enlarged side view of the direction-correcting roller assembly in the material-feeding device shown in FIG. 3, wherein first and second supporting plates are omitted.
Figure 6C:
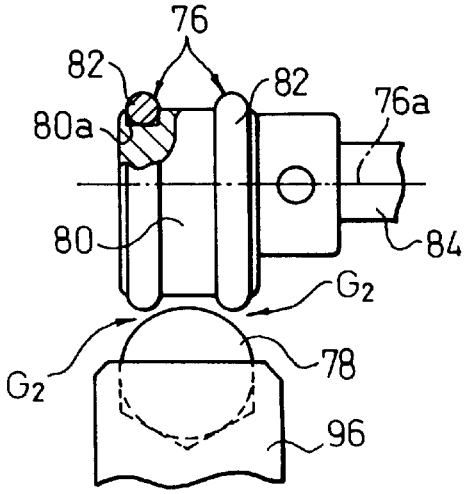
FIG. 6C is a partially cut-out enlarged side view of the direction-correcting roller assembly in the material-feeding device shown in FIG. 3, showing a condition different from that shown in FIG. 6B.

As shown in FIGS. 6A to 6C, the pair of polygonal rollers 76 are constructed by respectively fitting a pair of O-rings 82 into a pair of grooves 80*a* axially spaced from each other and circumferentially formed on the outer surface of a triangular prismic roller body 80 with rounded corners. The roller body 80 is coaxially fixed to one end of a shaft 84 having the rotation axis 76*a*. The shaft 84 is rotatably supported above the first supporting plate 64 and generally parallel to the latter, by a bearing member 86 (FIG. 4) fixedly connected to a stationary part such as a machine frame 18.

Referring again to FIGS. 3 to 5A, a bevel gear 88 is secured to the other end of the shaft 84. The bevel gear 88 is meshed with a counterpart second bevel gear 90 which is in turn secured to one end of a second shaft 92 rotatably held above the first supporting plate 64. The second shaft 92 extends obliquely to the shaft 84, and also extends parallel to the first supporting plate 64 and, preferably, to the material-guide surfaces 58*a* of the second guide member 58. A gear 94 constituting a part of a driving mechanism for the pair of polygonal rollers 76 is secured to the other end of the second shaft 92.

Figure 5B:
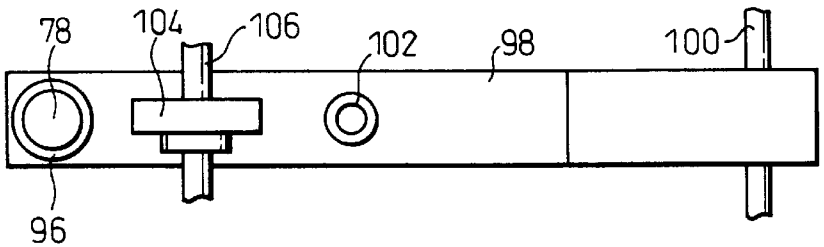
FIG. 5B is a schematic plan view of a ball-actuating mechanism in the material-feeding device shown in FIG. 3.

The ball 78 is supported on a ball pedestal 96 in a freely rotatable manner. As shown in FIGS. 5A and 5B, the ball pedestal 96 is fixedly located on a free end 98*a* of a first rocking arm 98 arranged beneath the second supporting plate 68. The first rocking arm 98 is arranged inside the base 52 and is pivotably supported at the other end thereof on a pivot shaft 100 connected to the base 52. The rocking arm 98 is elastically connected at the generally longitudinally center thereof to an upper plate 52*a* of the base 52 via a suspension spring 102. The suspension spring 102 elastically urges the ball 78 toward the pair of polygonal rollers 76 through the rocking arm 98 and the ball pedestal 96. The ball 78 is positioned on the rocking arm 98 so that one point on the outer circumferential surface of the ball nearest to the roller body 80 is equidistant from each of the pair of polygonal rollers 76.

Also, the rocking arm 98 is engaged with a ball-actuating cam 104 at a location between the free end 98*a* and the suspension spring 102. The ball-actuating cam 104 is secured to a cam driving shaft 106 rotatably supported on the base 52. The ball-actuating cam 104 maintains a condition wherein a circumferential cam surface 104*a* is abutted to the upper surface of the rocking arm 98 as the cam is rotated by the cam driving shaft 106, and thereby makes the rocking arm 98 pivot about the shaft 100 against the biasing force of the suspension spring 102.

When a minimum radius portion of the cam surface 104*a* is brought into contact with the rocking arm during the rotation of the ball-actuating cam 104, the ball 78 is located at an operative position nearest to the pair of polygonal rollers 76 under the elastic biasing force of the suspension spring 102. At this time, a part of the ball 78 projects into the material passage 54 through the opening 68*c* of the second supporting plate 68. When the ball 78 is in this operative position and, as shown in FIGS. 6A and 6B, the pair of polygonal rollers 76 are located at a rotational angle wherein circumferential flat portions thereof, i.e., linear sections of the respective O-rings 82, are opposed to the ball 78, sufficient gaps $G_1$ are defined between the pair of polygonal rollers 76 and the ball 78. The gaps $G_1$ allow the material to be printed M having a possible maximum thickness to freely pass through between the pair of polygonal rollers 76 and the ball 78.

Figure 7A:
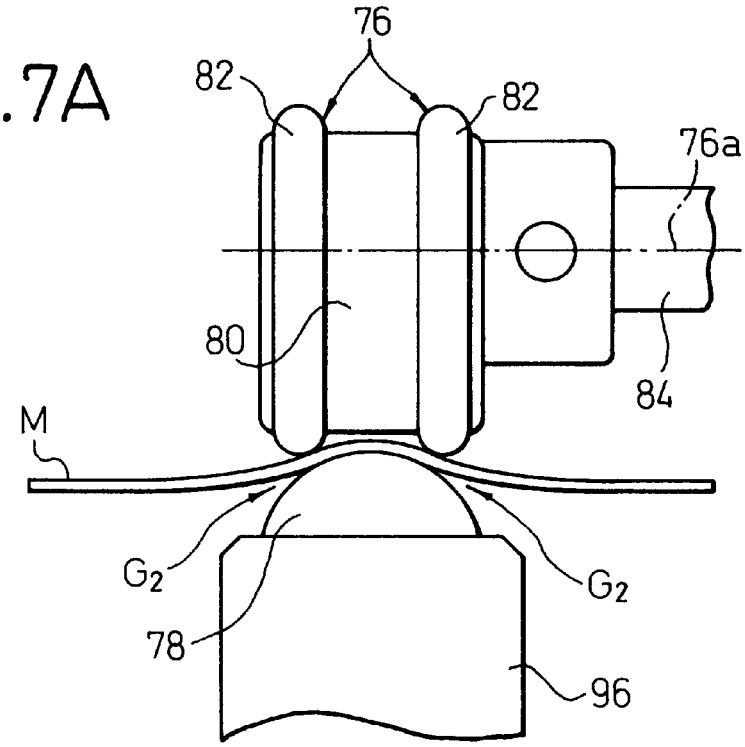
FIG. 7A is a view corresponding to FIG. 6C, illustrating a mode of operation of the direction-correcting roller assembly in connection with a thinner material.
Figure 7B:
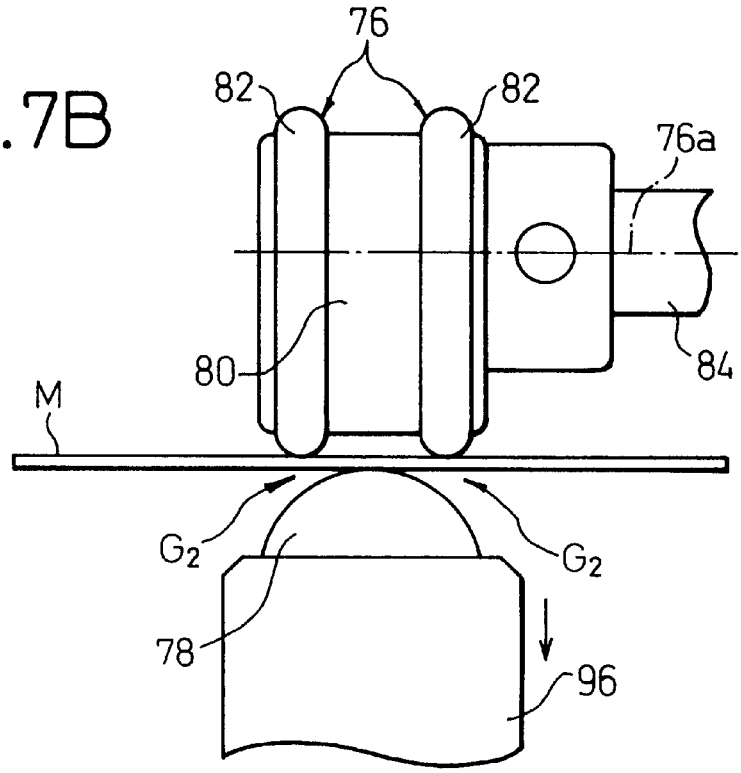
FIG. 7B is a view corresponding to FIG. 6C, illustrating a mode of operation of the direction-correcting roller assembly in connection with a thicker material.

Also, as shown in FIG. 6C, when the ball 78 is in the operative position and the pair of polygonal rollers 76 are located at a rotational angle wherein circumferential corner portions thereof, i.e., bent sections of the respective O-rings 82, are opposed to the ball 78, minimum gaps $G_2$ are defined between the pair of polygonal rollers 76 and the ball 78, and a part of the ball 78 enters a space between the polygonal rollers 76. The gaps $G_2$ allow the material to be printed M having a relatively small thickness (such as a slip) or the material M having a low stiffness to pass through between the pair of polygonal rollers 76 and the ball 78 in such a state that the material M is not clamped between the polygonal rollers 76 and the ball 78 but is bent in conformity with the circumferential surface of the ball (see FIG. 7A). On the other hand, when a relatively thicker material to be printed M (such as a bankbook) or the material M having a high stiffness is inserted between the pair of polygonal rollers 76 and the ball 78, the ball 78 is slightly depressed against the biasing force of the suspension spring 102 due to the stiffness of the material M (see FIG. 7B). As a result, the pair of polygonal rollers 76 and the ball 78 substantially clamp the material to be printed M under the elastic biasing force of the suspension spring 102.

Moreover, when the ball-actuating cam 104 is rotated and the maximum radius portion of the cam surface 104*a* is brought into contact with the rocking arm 98, the ball 78 is located in a non-operative position spaced from the pair of polygonal rollers 76 under the elastic biasing force of the suspension spring 102. In this state, even when the pair of polygonal rollers 76 are located at a rotational angle wherein bent sections of the respective O-rings 82 are opposed to the ball 78, sufficient gaps are defined between the pair of polygonal rollers 76 and the ball 78, which allow the material to be printed M having a maximum possible thickness to freely pass through the gaps.

It can be understood that, to establish the above-mentioned characteristic operation of the direction-correcting roller assembly 60, the pair of polygonal rollers 76 need not be limited to the above-mentioned triangular shape but may have any other polygonal shapes. It is important for every shapes that, when the ball 78 is in the operative position, the minimum gap $G_2$ is defined between the pair of the polygonal rollers 76 and the ball 78 at a rotational angular position wherein the circumferential corner portions of the polygonal rollers 76 are opposed to the ball 78.

The conveyor roll mechanism 62 is provided with two conveyor roll assemblies 108A and 108B spaced apart from each other in the material-feeding direction. Each of the conveyor roll assemblies 108A and 108B includes a driving roll 110 rotatable about a stationary rotation axis 110*a* extending vertically to the material-feeding direction and a plurality of driven rolls 112 independently biased toward the driving roll 110 to contact the latter and independently rotatable about a movable rotation axis 112*a* extending parallel to the stationary rotation axis 110*a*. Each driving roll 110 is arranged at the upper side of the first supporting plate 64, and each driven roll 112 is arranged at the lower side of the second supporting plate 68. Openings 64*d* and 68*d* are formed at positions corresponding to the respective driving rolls 110 and the respective driven rolls 112 (see FIG. 4), and each driving roll 110 can contact each driven roll 112 through the openings 64*d* and 68*d*.

Each driving roll 110 is secured to a shaft 114 having a stationary rotation axis 110*a*. In the illustrated embodiment, each driving roll 110 is axially divided into a plurality of subsections. Each shaft 114 extends orthogonal to the material-guide surface 56*a* of the first guide member 56 and is rotatably supported above the first supporting plate 64 and generally parallel to the latter. Pulleys 116 having the same outer diameters are secured to one end of each respective shaft 114 axially extending from each respective driving roll 110. The pulleys 116 are connected to an output shaft of a driving source 120 such as an electric motor via a belt 118. Thus, the respective driving rolls 110 are simultaneously driven by the driving source 120 at the same speed in the same direction. In this regard, instead of these pulleys 116 and the belt 118, well-known power transmitting systems such as a chain and sprocket or gear trains may be employed.

A gear 122 is secured to the shaft 114 of the upstream driving roll 110, in relation to the material-feeding direction, at a position between the driving roll 110 and the pulley 116. The gear 122 is meshed with the gear 94 secured to the other end of the second shaft 92 in the direction-correcting roller assembly 60. As a result, a torque from the output shaft of the driving source 120 is transmitted to the second shaft 92 via the belt 118, the pulleys 116, the gear 122 and the gear 94, and further transmitted to the pair of polygonal rollers 76 via the bevel gears 90, 88 and the shaft 84. In this manner, the driving mechanism including the driving source 120 for the driving rolls 110 of the conveyor roll mechanism 62 also constitutes the driving mechanism for the pair of polygonal rollers 76, and thus rotates the pair of polygonal rollers 76 synchronously with the conveyor roll mechanism 62.

As shown in FIGS. 5A, 8, 9A and 9B, the plural driven rolls 112 of the conveyor roll assembly 108A arranged upstream in the material-feeding direction respectively have movable rotation axis 112*a* and are individually supported on plural roll pedestals 124. The roll pedestals 124 are fixedly provided on respective free ends 126*a* of plural second rocking arms 126 arranged beneath the second supporting plate 68. Similar to the first rocking arm 98 supporting the ball 78, the second rocking arms 126 are arranged inside the base 52 and are pivotably supported at the other ends thereof on a second pivot shaft 128 connected to the base 52. Also, similar to the first rocking arm 98, each of the second rocking arms 126 is elastically connected at the generally longitudinally center thereof to the upper plate 52*a* of the base 52 via a suspension spring 130. Each suspension spring 130 elastically urges each driven roll 112 toward the driving roll 110 to contact therewith through the rocking arm 126 and the roll pedestal 124. rocking arm 126 and the roll pedestal 124.

Also, each of the second rocking arms 126 is engaged with a roll-actuating cam 132 at a location between the free end 126*a* and the suspension spring 130. Each roll-actuating cam 132 is secured to the cam driving shaft 106 rotatably supported on the base 52. The plural roll-actuating cams 132 respectively engaged with the plural rocking arms 126 are fixed to the cam driving shaft 106 in the same phase. The roll-actuating cams 132 maintain a condition wherein circumferential cam surfaces 132*a* are abutted to the upper surfaces of the respective rocking arms 126 as the cams are simultaneously rotated by the cam driving shaft 106, and thereby make the rocking arms 126 synchronously pivot about the shaft 128 against the biasing force of the suspension springs 130.

When a minimum radius portion of the cam surface 132*a* is brought into contact with each rocking arm 126 during the rotation of each roll-actuating cam 132, each driven roll 112 is located at an operative position to contact with the driving roll 110 under the elastic biasing force of the suspension spring 130. In this state, the upstream conveyor roll assembly 108A, in the material-feeding direction, can hold the material to be printed M between the driving roll 110 and the plural driven rolls 112 under the mutually independent biasing force of the plural suspension springs 130. Further, when each roll-actuating cam 132 is rotated and the maximum radius portion of the cam surface 132*a* is brought into contact with each rocking arm 126, each driven roll 112 is located in a non-operative position spaced from the driving roll 110 under the elastic biasing force of the suspension spring 130. In this state, sufficient gaps are defined, between the driving roll 110 and the plural driven rolls 112, to allow the material to be printed M having a possible maximum thickness to freely pass through the gaps.

On the other hand, the plural driven rolls 112 of the conveyor roll assembly 108B arranged downstream in the material-feeding direction respectively have movable rotation axis 112*a* and are individually supported on plural roll pedestals 134. The roll pedestals 134 are fixedly provided on respective free ends 136*a* of plural third rocking arms 136 arranged beneath the second supporting plate 68. The third rocking arms 136 are aligned respectively with the second rocking arms 126 inside the base 52 and are pivotably supported at the other ends thereof on the first pivot shaft 100 connected to the base 52. Also, similar to the second rocking arms 126, each of the third rocking arms 136 is elastically connected at a distal end thereof to the upper plate 52*a* of the base 52 via a suspension spring 138. Each suspension spring 138 elastically urges each driven roll 112 toward the driving roll 110 to contact therewith through the rocking arm 136 and the roll pedestal 134.

The third rocking arm 136 is not provided with means for displacing the same, such as the roll-actuating cam 132 engaged with the second rocking arm 126. Therefore, each driven roll 112 carried by the third rocking arm 136 is always located in the operative position to contact with the driving roll 110 under the elastic biasing force of the suspension spring 138. As a result, the downstream conveyor roll assembly 108B, in the material-feeding direction, can always hold the material to be printed M between the driving roll 110 and the plural driven rolls 112 under the independent biasing force of the plural suspension springs 138.

The printing area P of the ink-jet printer 10 is defined between the two conveyor roll assemblies 108A and 108B. Accordingly, an opening 64*e* is formed in the first supporting plate 64 in a region between the two conveyor roll assemblies 108A and 108B, which extend over substantially the entire transverse length of the material passage 54 (FIG. 4). The printing head 12 of the ink-jet printer 10 moves to-and-fro along the guide bar 26 above the printing area P and scans the material to be printed M introduced into the printing area P, to form letters or images on the material M with ink droplets ejected from the plural nozzles 28.

As already described, the material-feeding device 14 employs an arrangement wherein the upper surface of the material to be printed M, i.e., the surface to be printed, is held at a uniform height by the support face 64*a* of the first supporting plate 64, while, when using the materials M having different thicknesses, the second supporting plate 68 is shifted in a floating manner on the bearing springs 66, so as to displace the support face 68*a* of the second supporting plate 68 as a bottom face of the material passage 54.

Figure 10:
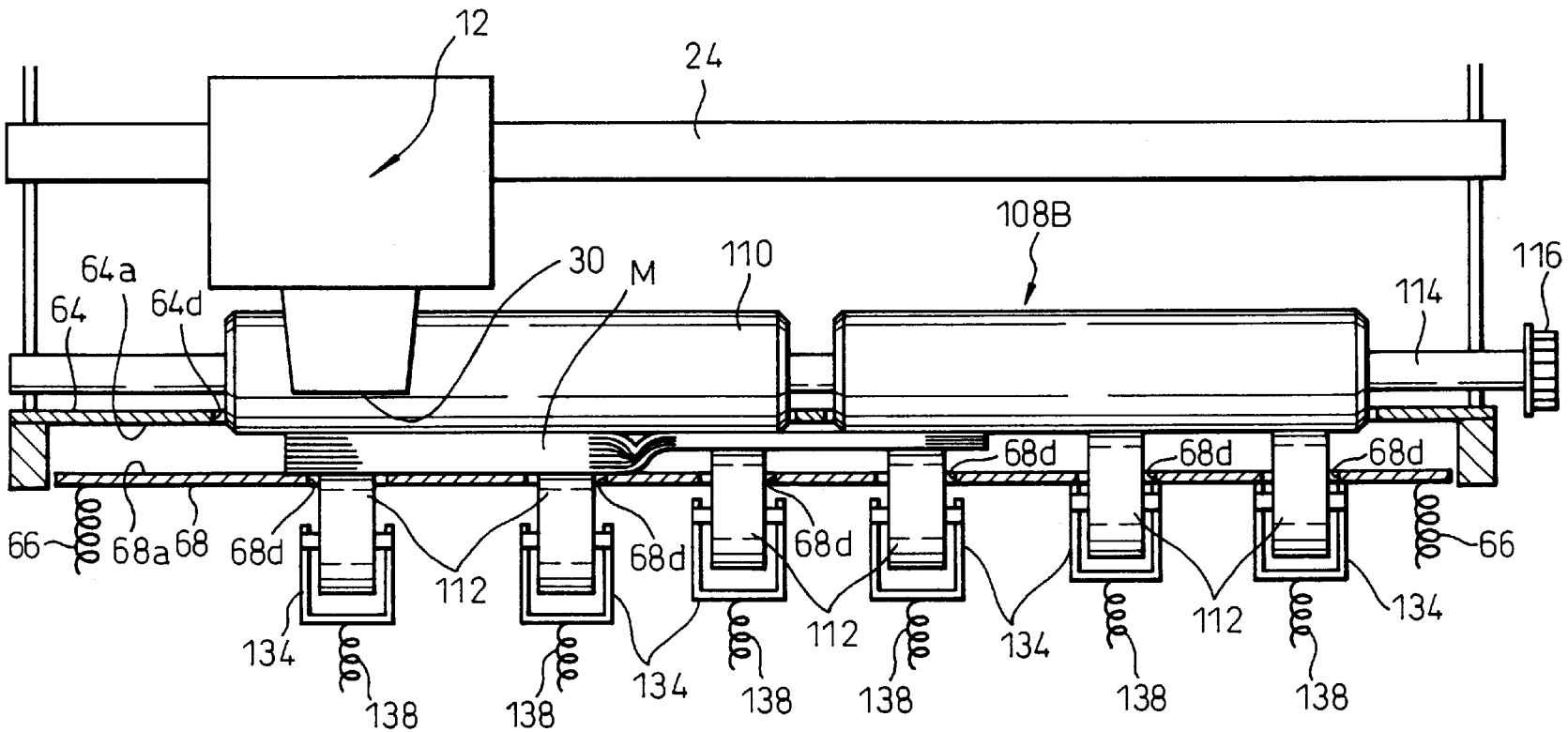
FIG. 10 is a schematic sectional view of the material-feeding device taken along line X—X in FIG. 4, wherein a printing head and a material to be printed are also shown.
Figure 11A:
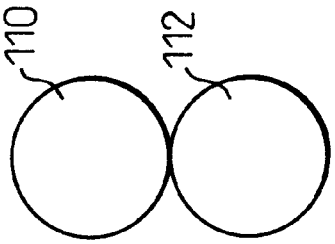
FIG. 11A is a schematic front view of a shutter-actuating mechanism in the material-feeding device shown in FIG. 3.
Figure 11A:
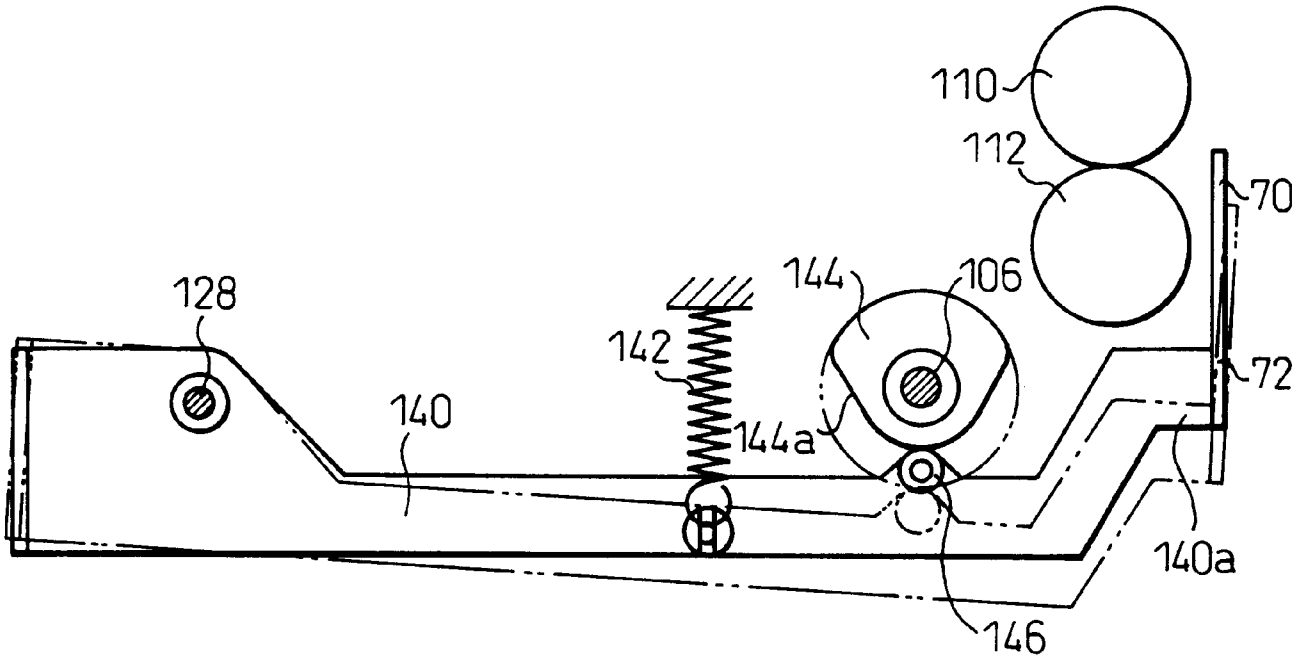
Figure 11B:
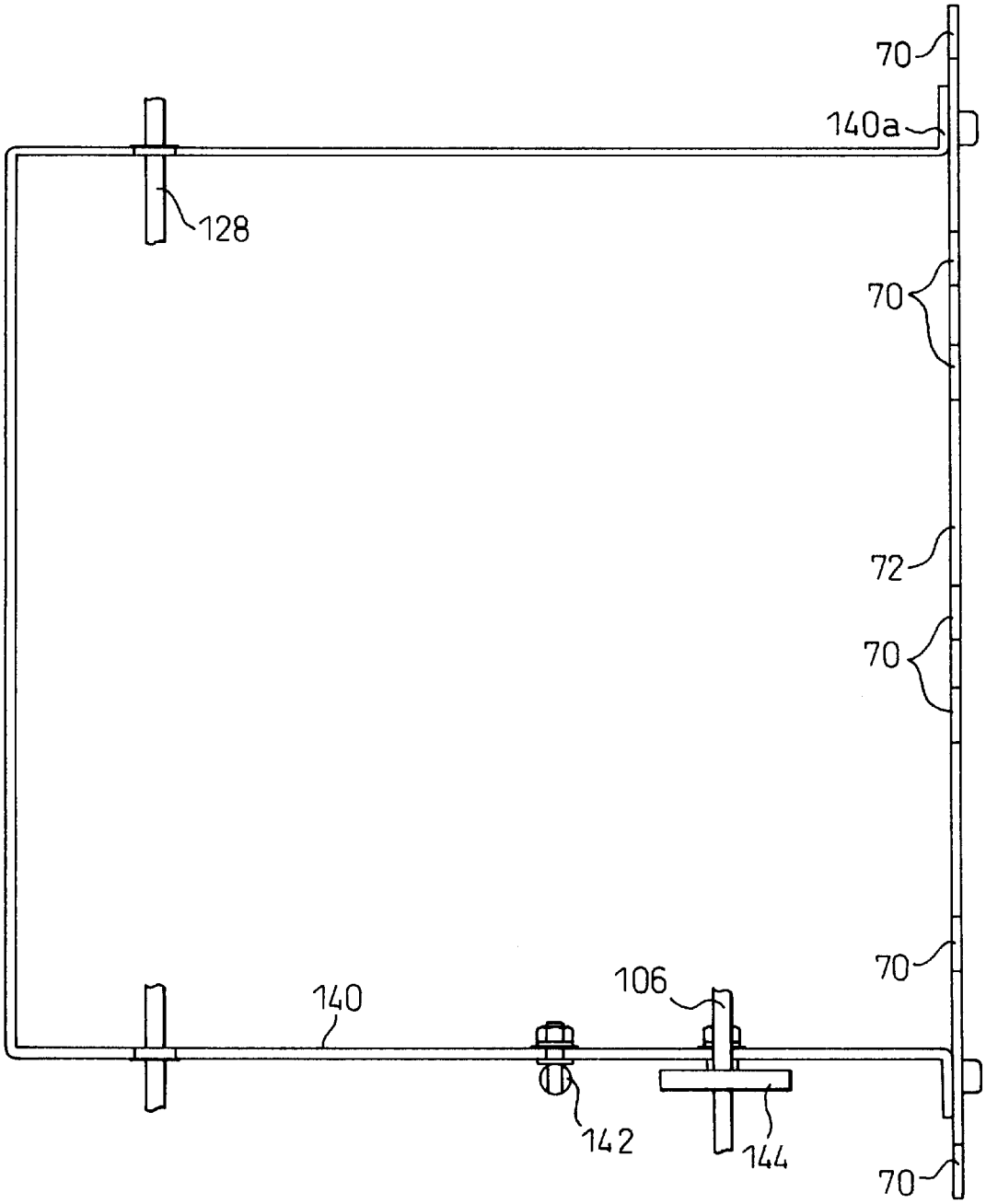
FIG. 11B is a schematic plan view of the shutter-actuating mechanism in the material-feeding device shown in FIG. 3.

For example, when the printing operation is carried out on the notebook type material M such as a bankbook, and if the material parts with different thicknesses are produced on the left and right sides relative to the stitching line of the material M, the plural driven rolls 112, in the respective areas of the conveyor roll assemblies 108A, 108B, are independently urged toward the operative positions under the elastic biasing force of the respective suspension springs 130, 138, whereby the material parts with different thicknesses are surely held between the driving rolls 110 and the driven rolls 112 positionally corresponding to the respective material parts, as diagrammatically shown in FIG. 10 in connection with the conveyor roll assembly 108B. It will be understood that this mode of operation of the driven rolls 112 as independent suspensions is effective in such a condition not only that the material to be printed M is fed in a direction generally parallel to the stitching line thereof but also that the material M is fed in a direction generally orthogonal to the stitching line.

In this manner, according to the material-feeding device 14, the printing surface of the material to be printed M is always maintained at a constant height when the printing operation is sequentially or continuously carried out on various materials M having different thicknesses or when the printing operation is continuously carried out on a desired opened page(s) of the notebook type material M such as a bankbook. Accordingly, even if the thickness of the material M varies during the continuous printing operation, it is unnecessary to change the height of the printing head 12 relative to the first supporting plate 64, and a predetermined printing quality can be surely maintained. As a result, according to the material-feeding device 14, it is possible to simplify the driving unit for the printing head 12 and to improve a printing speed without deteriorating the printing quality. In this respect, such a constitution and effects of the material-feeding device 14 are not easily established in an impact printer wherein the bottom side of the material to be printed M must be statically supported during the printing operation, but are especially effectively established in an ink-jet printer wherein the bottom side of the material to be printed M does not need to be statically supported during the printing operation.

As shown in FIGS. 5A, 8, 11A and 11B, the above-mentioned plural shutters 70 constituting the second guide member 58 are integrally connected to each other under the second supporting plate 68 to form the comb-teeth plate 72. The comb-teeth plate 72 is arranged downstream of and closer to the plural driven rolls 112 of the upstream conveyor roll assembly 108A in the material-feeding direction.

The comb-teeth plate 72 is fixed to a free end 140*a* of a rocking frame 140 arranged beneath the second supporting plate 68. The rocking frame 140 is arranged inside the base 52, similar to the second rocking arms 126 supporting the driven rolls 112, and is pivotably supported at the other end thereof on the second pivot shaft 100 connected to the base 52. Also, similar to the second rocking arms 126, the rocking frame 140 is elastically connected at the generally center of the longitudinal portion thereof, which is generally orthogonal to the comb-teeth plate 72, to the upper plate 52*a* of the base 52 via a suspension spring 142. The suspension spring 142 elastically urges the plural shutters 70 of the comb-teeth plate 72 toward the second supporting plate 68 through the rocking frame 140.

Also, the rocking frame 140 is engaged with a shutter-actuating cam 144 at a location between the free end 140*a* and the suspension spring 142. The shutter-actuating cam 144 is secured to the cam driving shaft 106 rotatably supported on the base 52. The shutter-actuating cam 144 maintains a condition wherein a circumferential cam surface 144*a* is abutted to a projection 146 laterally projecting from the rocking frame 140 as the cam is rotated by the cam driving shaft 106, and thereby makes the rocking frame 140 pivot about the shaft 128 against the biasing force of the suspension spring 142.

The above-mentioned openings 68*d* and further openings 68*e* are formed in the second supporting plate 68 at positions corresponding to the plural shutters 70 of the comb-teeth plate 72. Also, the above-mentioned openings 64*d* are formed in the first supporting plate 64 at positions corresponding to the plural shutters 70 of the comb-teeth plate 72.

When a minimum radius portion of the cam surface 144*a* is brought into contact with the projection 146 of the rocking frame 140 during the rotation of the shutter-actuating cam 144, the plural shutters 70 of the comb-teeth plate 72 project into the material passage 54 through the respective openings 64*d*, 68*d* and 68*e* of the first and second supporting plates 64 and 68 under the elastic biasing force of the suspension spring 142. In this state, the plural shutters 70 interrupt the forward movement of the material to be printed M passing through the upstream conveyor roll assembly 108A, in the material-feeding direction, to act as the second guide member 58. Moreover, when the shutter-actuating cam 144 is rotated and a maximum radius portion of the cam surface 144*a* is brought into contact with the projection 146 of the rocking frame 140, the plural shutters 70 are located in the non-operative position where the shutters are retracted from the material passage 54 to a location beneath the second supporting plate 68 under the elastic biasing force of the suspension spring 142. In this state, the material to be printed M is movable in the material passage 54 toward the downstream conveyor roll assembly 108B in the material-feeding direction.

Figure 8:
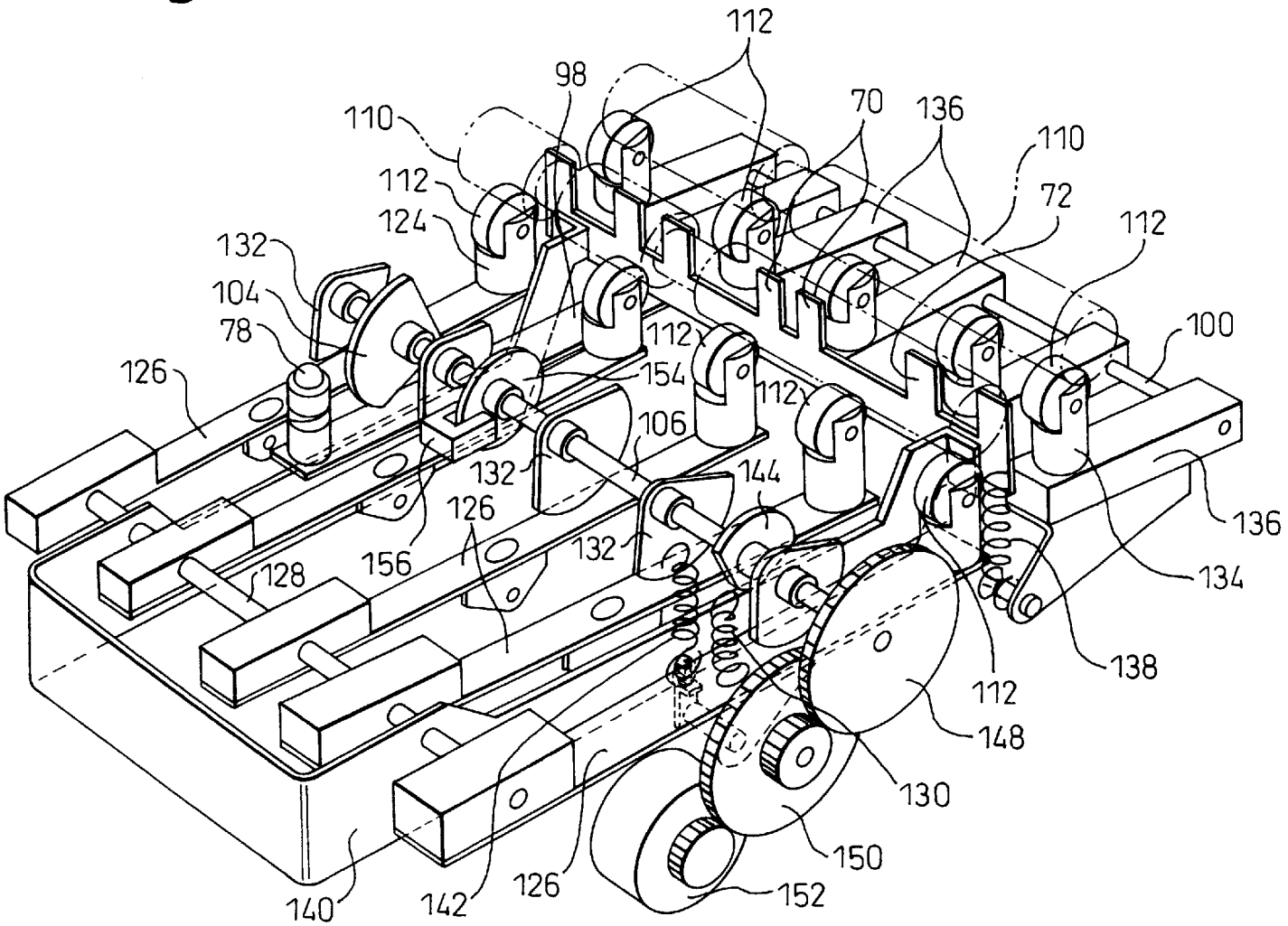
FIG. 8 is a schematic perspective view illustrating various actuating mechanisms in the material-feeding device shown in FIG. 3.
Figure 9A:
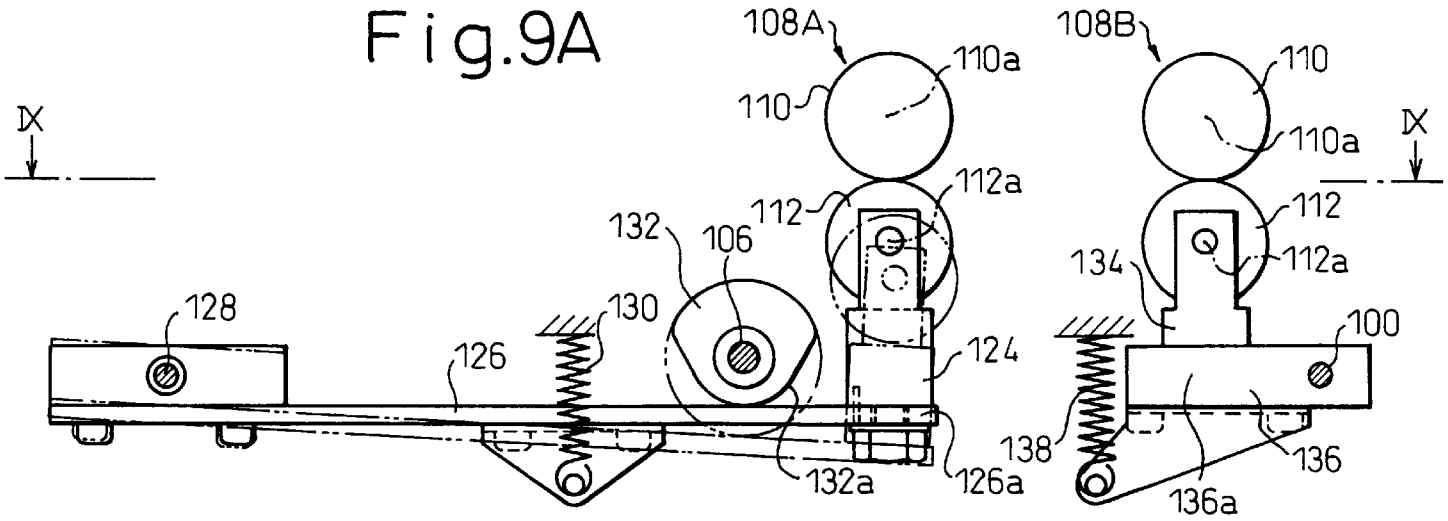
FIG. 9A is a schematic front view of a roller-actuating mechanism in the material-feeding device shown in FIG. 3.
Figure 9B:
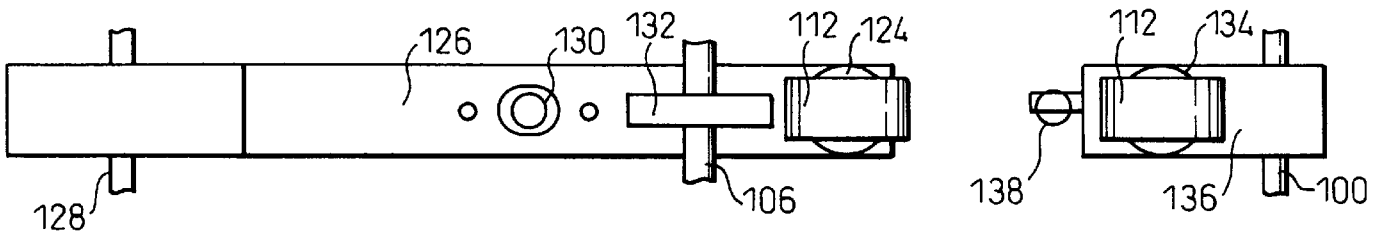
FIG. 9B is a schematic plan view of the roller-actuating mechanism in the material-feeding device shown in FIG. 3.
Figure 12:
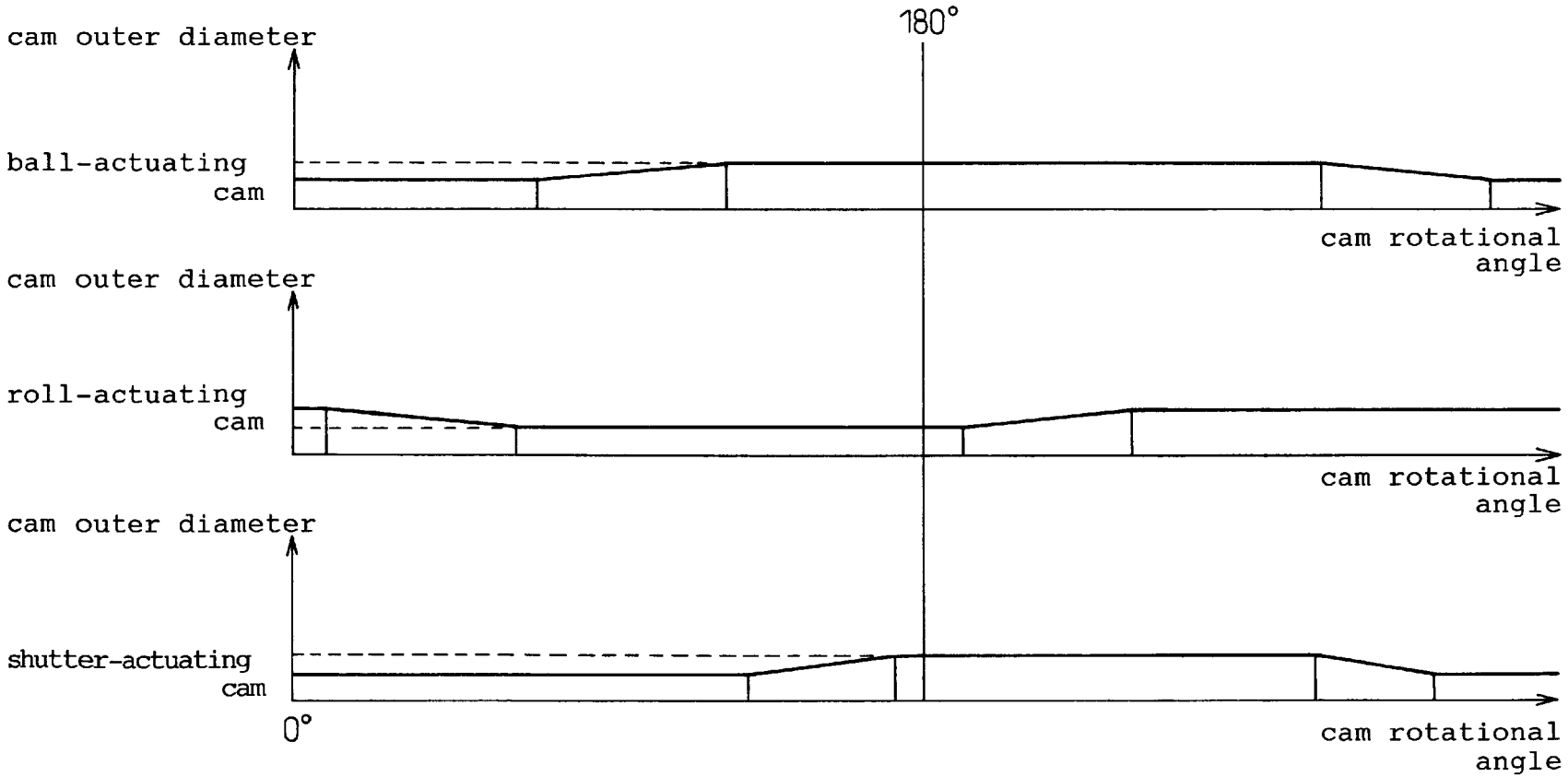
FIG. 12 illustrates timing charts of the operation of various actuating mechanisms of the material-feeding device shown in FIG. 3.

The above-mentioned various actuating mechanisms arranged beneath the second supporting plate 68 are located in a mutual positional relationship as diagrammatically shown in FIG. 8. The cam driving shaft 106, on which the ball-actuating cam 104, the plural roll-actuating cams 132 and the shutter-actuating cam 144 are secured, is provided with a gear 148 fixed to an end of the shaft extending outward from the base 52. The gear 148 is connected to a driving source 152 such as an electric motor via a gear train 150. Accordingly, an output torque from the driving source 152 is transmitted to the ball-actuating cam 104, the plural roll-actuating cams 132 and the shutter-actuating cam 144 via the gear train 150, the gear 148 and the cam driving shaft 106, so as to simultaneously rotate these cams and pivot, in a predetermined timing as shown in FIG. 12, the first and second rocking arms 98, 126 and the rocking frame 140 in accordance with the profiles of the respective cam surfaces 104*a*, 132*a* and 144*a*.

Further, a wheel 154 having a notch (not shown) at a predetermined circumferential position is secured to the cam driving shaft 106. The wheel 154 defines a starting point of the operation of the ball-actuating cam 104, the roll-actuating cams 144 and the shutter-actuating cam 144 in cooperation with a sensor 156 provided in the base 52.

The mode of operation of the material-feeding device 14 with the above-mentioned constitution will be described below.

First, in a resetting operation, the ball-actuating cam 104, the plural roll-actuating cams 132 and the shutter-actuating cam 144 are located at predetermined rotational angle positions rotated from the starting point of operation, so as to set the ball 78 of the direction-correcting roller assembly 60 in the operative position, the plural driven rolls 112 of the conveyor roll assembly 108A in the non-operative position, and the plural shutters 70 of the second guide member 58 in the operative position.

Then, when the user manually inserts the material to be printed M into the material passage 54 from the material inlet 54*a*, the inlet sensor 55*a* detects the insertion of the material M to start the driving source 120. Thereby, the pair of polygonal rollers 76 of the direction-correcting roller assembly 60 and the respective driving rolls 110 of the conveyor roll mechanism 62 start to rotate. The material M is forcibly inserted by hand until the material M reaches the direction-correcting roller assembly 60.

Once the material to be printed M is inserted between the pair of polygonal rollers 76 and the ball 78 of the direction-correcting roller assembly 60, the material M is fed toward the guide members 56, 58 by the rotation of the pair of polygonal rollers 76. In this step, the direction-correcting roller assembly 60 holds the material M between the pair of polygonal rollers 76 and the ball 78 at a rotational angle in which the bent sections, i.e., the radially outermost sections, of the respective O-rings 82 of the polygonal rollers 76 are opposed to the ball 78 (FIG. 6C), while it releases the material M at a rotational angle in which the linear sections of the respective O-rings 82 are opposed to the ball 78 (FIGS. 6A and 6B). Accordingly, the material to be printed M is subjected to an intermittent feeding action by the continuous rotation of the pair of polygonal rollers 76, irrespective of the thickness of the material, and is gradually fed toward the guide members 56 and 58.

More specifically, once the material to be printed M reaches the pair of rotating polygonal rollers 76, a leading edge of the material M is moved toward the first guide member 56. Consequently, the material M is moved forward while rotating in a counterclockwise direction as seen in FIG. 4, until it comes into contact with the first guide member 56. Once an intersection of the leading and leftward edges of the material M comes into contact with the first guide member 56, the material M is restricted in the rotational motion thereof and is fed in its entirety toward the first guide member 56 and, thereafter the leftward edge thereof becomes parallel to the first guide member 56, and finally the material M reaches the second guide member 58 while maintaining the parallel condition. In this manner, the material to be printed M is correctly oriented to a predetermined material-feeding direction A, whereby all the first and second guide sensors 55*b* and 55*c* output abutment-completion signals.

It should be noted that there is a case where the leftward edge of the material to be printed M does not become parallel with the first guide member 56 even when the material M reaches the second guide member 58, depending on the posture and position of the material M upon insertion thereof. In this case, either of the first and second guide sensors 55*b* and 55*c* detects an incomplete contact state, and thereby the material M is ejected by, e.g., the reverse rotation of the polygonal rollers 76.

It will be understood that at least one of the first guide sensor 55*b* and the second guide sensor 55*c* must be plural, for the purpose of accurately correcting the direction of the material M.

During the incomplete contact state, if the pair of polygonal rollers 76 continue to rotate in such a condition that the material to be printed M is abutted with the first and second guide members 56, 58, the radially outermost sections of the polygonal rollers 76 act to force the material M onto the first and second guide members 56, 58, and thereby strain is caused in the material M. However, as the pair of polygonal rollers 76 rotate, a contact pressure between the rollers 76 and the material M decreases as already described and thus a frictional driving force for the material M is reduced, so that the material M can relieve the strain. As a result, even if the material M in abutment with the first and second guide members 56, 58 continues to be subjected to the driving force of the pair of polygonal rollers 76, the material M is prevented from being folded or creased.

Also, in a case where the material to be printed M is a relatively thin one (e.g., a slip) or has a lower stiffness, there is a risk, during the above direction-correcting step, that the material M cannot bear the abutting force against the first and second guide members 56, 58 and thus is folded or creased, if there is an instant when the material M is clamped between the pair of polygonal rollers 76 and the ball 78 during the intermittent feeding operation of the direction-correcting roller assembly 60. According to the material-feeding device 14 of the present invention, as already described, the minimum gaps $G_2$ are formed between the pair of polygonal rollers 76 and the ball 78 at a rotational angle where the bent sections of the respective O-rings 82 of the pair of polygonal rollers 76 are opposed to the ball 78 located in the operative position (FIG. 6C), so as to allow the material M to pass through between the pair of polygonal rollers 76 and the ball 78 while being bent in conformity with the outer circumferential surface of the ball (FIG. 7A) without being clamped between the pair of polygonal rollers 76 and the ball 78. Therefore, even if the material M is intermittently subjected to the abutting force against the first and second guide members 56, 58, the material M is slidable between the pair of polygonal rollers 76 and the ball 78 under the abutting force, and therefore is effectively prevented from being bent or generating creases due to the abutting force.

After the feeding direction of the material to be printed M has been corrected in this manner, the driving source 152 starts to simultaneously rotate the ball-actuating cam 104, the plural roll-actuating cams 132 and the shutter-actuating cam 144 through the cam driving shaft 106, and makes the first rocking arm 98, the second rocking arms 126 and the rocking frame 140 pivot in accordance with a predetermined timing shown in FIG. 12.

As shown in FIG. 12, from the resetting position, the plural roll-actuating cams 132 first decrease radius of the cam surfaces 132*a* thereof abutted to the rocking arms 126. Thereby, the plural driven rolls 112 of the conveyor roll assembly 108A are put into the operative position under the elastic biasing force of the respective suspension springs 130 to comes into contact with the driving roll 110. Next, the ball-actuating cam 104 increases a radius of the cam surface 104*a* thereof abutting to the rocking arm 98. Thereby, the ball 78 of the direction-correcting roller assembly 60 is put into the non-operative position away from the pair of polygonal rollers 76 under the elastic biasing force of the suspension spring 102. Finally, the shutter-actuating cam 144 increases a radius of the cam surface 144*a* thereof abutting to the rocking frame 140. Thereby, the plural shutters 70 of the second guide member 58 is put into the non-operative position retracted from the material passage 54 under the elastic biasing force of the suspension spring 142.

In this state (at a cam rotational angle 180°), the material to be printed M is fed by the conveyor roll mechanism 62 into the printing area P, and the printing operation is carried out by the printing head 12. After the completion of the desired printing operation, the driving source 120 rotates in reverse to eject the material M from the printing area P by the conveyor roll mechanism 62. At that time, both the shutter 70 and the ball 78 are located in the non-operative position, so as not to interrupt the ejection of the material M.

After the material to be printed M is withdrawn from the material passage 54 by a user, the cam driving shaft 106 further rotates to increase the radius of the cam surfaces 132*a* of the roll-actuating cams 132 abutting to the rocking arms 126, so that the driven rolls 112 are put into the respective non-operative positions apart from the driving roll 110 under the elastic biasing force of the suspension springs 130. Thereafter, the shutters 70 and the ball 78 are sequentially shifted to the operative positions by the respective rotations of the shutter-actuating cam 144 and the ball-actuating cam 104, so as to reach the resetting position.

INDUSTRIAL APPLICABILITY

The present invention provides a material-feeding device having a direction-correcting function for correctly and stably feeding various materials with different thicknesses in a predetermined direction. The material-feeding device of the present invention is suitable for printers of industrial use and, particularly, for bankbook printers. Further, according to the present invention, an ink-jet printer including such a high-performance material-feeding device is provided.

What is claimed is:

1. A material-feeding device comprising:

a base;

a material passage formed on said base;

at least one guide member provided in said material passage and having a material-guide surface;

a direction-correcting roller assembly provided in said material passage, said direction-correcting roller assembly including a pair of integrally rotatable polygonal rollers having a common rotation axis oblique to said material-guide surface of said guide member and a freely rotatable ball opposed to said pair of polygonal rollers and elastically supported in an operative position closer to said polygonal rollers to define a gap between said ball and each of said polygonal rollers for allowing a material to be inserted into said gap when said ball is in said operative position;

a driving mechanism for driving said pair of polygonal rollers for rotation; and a conveyor roll mechanism provided downstream, in a material-feeding direction, of said direction-correcting roller assembly, for conveying the material along said material passage.

2. A material-feeding device as defined in claim 1, wherein said direction-correcting roller assembly is arranged to define a minimum gap between said pair of polygonal rollers and said ball when said ball is in said operative position and when said pair of polygonal rollers are in a rotational angular position wherein a circumferential corner of each of said polygonal rollers is opposed to said ball.

3. A material-feeding device as defined in claim 1, wherein said material passage is formed between a first supporting plate statically disposed above said base and a second supporting plate elastically supported on said base to be opposed to said first supporting plate.

4. A material-feeding device as defined in claim 3, wherein said first supporting plate and said second supporting plate include an upper support face and a lower support face, respectively, which are opposed to each other to slidably hold the material therebetween, said lower support face acting to elastically urge the material against said upper support face.

5. A material-feeding device as defined in claim 1, wherein said guide member comprises a first guide member statically projecting in said material passage and positioning said material-guide surface in parallel to said material-feeding direction, and a second guide member retractably projecting in said material passage and located downstream, in said material-feeding direction, of said direction-correcting roller assembly.

6. A material-feeding device as defined in claim 1, further comprising detecting means for detecting a position of the material in said material passage.

7. A material-feeding device as defined in claim 1, further comprising an actuating mechanism for shifting said ball elastically supported in said operative position in a direction away from said pair of polygonal rollers.

8. A material-feeding device as defined in claim 1, wherein said driving mechanism rotates said pair of polygonal rollers in cooperation with said conveyor roll mechanism.

9. A material-feeding device as defined in claim 1, wherein said conveyor roll mechanism includes at least one conveyor roll assembly, said at least one conveyor roll assembly including a driving roll rotatable about a stationary axis and a plurality of driven rolls biased toward said driving roll and rotatable about a movable axis.

10. A material-feeding device as defined in claim 9, further comprising an actuating mechanism for simultaneously shifting said driven rolls in a direction away from said driving roll.

11. A material-feeding device as defined in claim 9, wherein said driving roll is arranged at an upper side of said material passage, and wherein said driven rolls are arranged at a lower side of said material passage and are individually elastically biased in a direction toward said driving roll.

12. An ink-jet printer comprising:

a machine frame;

a printing head provided reciprocatingly movably in a predetermined direction in said machine frame, said printing head including a plurality of nozzles for ejecting ink-droplets and at least one nozzle surface on which said nozzles open;

ink-supply means for supplying ink to said printing head; and a material-feeding device for feeding a material to be printed into a printing area opposed to said printing head in said machine frame;

wherein said material-feeding device comprises:

a base placed in said machine frame;

a material passage formed on said base;

at least one guide member provided in said material passage and having a material-guide surface;

a direction-correcting roller assembly provided in said material passage, said direction-correcting roller assembly including a pair of polygonal rollers having a common rotation axis oblique to said material-guide surface of said guide member and a freely rotatable ball opposed to said pair of polygonal rollers and elastically supported in an operative position closer to said polygonal rollers to define a gap between said ball and each of said polygonal rollers for allowing the material to be printed to be inserted into said gap when said ball is in said operative position;

a driving mechanism for driving said pair of polygonal rollers for rotation; and a conveyor roll mechanism provided downstream, in a material-feeding direction, of said direction-correcting roller assembly, for conveying the material to be printed into said printing area along said material passage.

13. An ink-jet printer as defined in claim 12, wherein said direction-correcting roller assembly of said material-feeding device is arranged to define a minimum gap between said pair of polygonal rollers and said ball when said ball is in said operative position and when said pair of polygonal rollers are in a rotational angular position wherein a circumferential corner of each of said polygonal rollers is opposed to said ball.

14. An ink-jet printer as defined in claim 12, wherein said guide member of said material-feeding device comprises a first guide member statically projecting in said material passage and positioning said material-guide surface in parallel to said material-feeding direction, and a second guide member retractably projecting in said material passage and located downstream, in said material-feeding direction, of said direction-correcting roller assembly.

15. An ink-jet printer as defined in claim 14, wherein said conveyor roll mechanism of said material-feeding device includes a pair of conveyor roll assemblies arranged at both sides of said printing area in relation to said material-feeding direction, each of said conveyor roll assemblies including a driving roll rotatable about a stationary axis and a plurality of driven rolls biased toward said driving roll and rotatable about a movable axis, and wherein said second guide member is provided to retractably project between upstream one of said conveyor roll assemblies in relation to said material-feeding direction and said printing area.

16. An ink-jet printer as defined in claim 15, adapted to be used as a bankbook printer, wherein said driving roll is arranged at an upper side of said material passage, and wherein said driven rolls are arranged at a lower side of said material passage and are individually elastically biased in a direction toward said driving roll.

17. An ink-jet printer as defined in claim 12, adapted to be used as a bankbook printer, wherein said material passage of said material-feeding device is formed between a first supporting plate statically disposed above said base and a second supporting plate elastically supported on said base to be opposed to said first supporting plate.

18. An ink-jet printer as defined in claim 17, wherein said first supporting plate and said second supporting plate include an upper support face and a lower support face, respectively, which are opposed to each other to slidably hold the material therebetween, said lower support face acting to elastically urge the material against said upper support face.

19. A material-feeding device comprising:

a base;

a first supporting plate statically arranged above said base;

a second supporting plate elastically supported on said base to be opposed to said first supporting plate, to form a material passage between said first and second supporting plates; and a conveyor roll mechanism provided in said material passage for conveying a material along said material passage;

wherein said first supporting plate and said second supporting plate include an upper support face and a lower support face, respectively, which are opposed to each other to slidably hold the material therebetween, said lower support face acting to elastically urge the material against said upper support face; and wherein said conveyor roll mechanism includes a driving roll arranged at an upper side of said material passage to be rotatable about a stationary axis and a plurality of driven rolls arranged at a lower side of said material passage to be rotatable about a movable axis, said driven rolls being individually elastically biased in a direction toward said driving roll.

20. An ink-jet printer containing a material-feeding device as defined in claim 19.

21. A material-feeding device as defined in claim 19, wherein said driven rolls of said conveyor roll mechanism are disposed in an axially side-by-side arrangement.

22. A material-feeding device as defined in claim 19, wherein said driven rolls of said conveyor roll mechanism are individually elastically biased independently of said second supporting plate.

* * * * *